US005370286A

United States Patent [19]

Newman

[11] Patent Number: 5,370,286

[45] Date of Patent: Dec. 6, 1994

[54] ADJUSTABLE STRAP

[76] Inventor: Arthur J. Newman, 290 Huntington Cir., Alpharetta, Ga. 30201

[21] Appl. No.: 22,992

[22] Filed: Feb. 26, 1993

[51] Int. Cl.[5] ..... A45L 15/00

[52] U.S. Cl. ..... 224/151; 224/250; 224/257; 294/149; 119/857

[58] Field of Search ..... 224/151, 250, 257, 258, 224/224; 294/147, 149, 150, 153, 156; 119/857, 863, 768, 770; 24/3 C

[56] References Cited

U.S. PATENT DOCUMENTS

| | | | |
|---|---|---|---|
| 2,812,123 | 11/1957 | Girton | 224/151 |
| 3,559,853 | 2/1971 | Strassman | 224/258 |
| 4,440,334 | 4/1984 | Kappel | 224/258 |
| 4,470,528 | 9/1984 | Dyess | 224/257 |
| 4,676,417 | 6/1987 | Hirschkoff | 224/202 |
| 4,760,944 | 8/1988 | Hughes | 224/205 |
| 5,044,538 | 9/1991 | Bader | 224/250 |

FOREIGN PATENT DOCUMENTS

| | | | |
|---|---|---|---|
| 2586581 | 3/1987 | France | 294/147 |

*Primary Examiner*—Henry J. Recla
*Assistant Examiner*—David J. Walczak
*Attorney, Agent, or Firm*—Hopkins & Thomas

[57] ABSTRACT

A universal adjustable carrying strap which has first and second strap members. Both ends of the first strap member pass through a first slide and one of the ends is doubled back and affixed to itself, forming a loop having a slidable clip. The other end of the fist strap passes through a ring member at the fist slide, a second slide, a pad or grip, and a third slide, both ends of the second strap member pass through a fourth slide and one of the ends is doubled back upon and affixed to itself forming a loop having a slidable clip. The other end of the second strap member passes through a ring member of the fourth slide, the third slide, the pad or grip, and the second slide, underlying the first strap.

6 Claims, 3 Drawing Sheets

ADJUSTABLE STRAP

FIELD OF INVENTION

This invention relates to carrying devices, and more particularly, to a carrying strap having a wide range of applications.

BACKGROUND OF THE INVENTION

For active persons such as hikers and back packers, campers or those involved in moving or carrying objects, especially long or awkwardly shaped objects, a rope has long been recognized as an almost necessary accessory. A rope can be used to lift or carry, or to pull, objects that are otherwise awkward to carry, or to carry objects while leaving one or both arms and hands free. One of the disadvantages to using rope for such tasks is the necessity of knotting the rope securely to the object to be carried, i.e., the work piece. Unless the user is adept at tying the proper knots, it is not unusual for the knot to slip or come undone, often with unfortunate consequences. In addition, where only a short length of rope is needed, the question of what to do with any excess length poses a problem. As a consequence, there have been numerous attempts to replace a rope with other means which overcome the inconvenience or disadvantages thereof.

In U.S. Pat. No. 4,676,417 of Hirschkoff, there is shown a carrying strap for skis, which is adjustable in length and has carrying loops at each end. The strap performs the same functions as would a rope while eliminating the necessity of tying knots in the rope or otherwise securing it to the skis, and offers easy storage as a belt when not in use. The loops at the ends of the strap are retractable so as to be unobtrusive when the strap is used as a belt, and are formed using Velcro® material. The loops are adapted to hold a pair of skis and accompanying ski poles, and are secured by the Velcro® material. The use of such material makes looping the strap around the skis and affixing it both simple and quick. However, Velcro® fasteners under tension can quickly come apart when the load is too great, and, additionally, the size of the loop is dependent upon the placement of the Velcro® members.

In U.S. Pat. No. 4,760,944 of Hughes, there is shown a sling assembly for bows, rifles, and the like wherein, in the case of the rifle, a mounting member is affixed to the stock of the rifle as by Velcro® fasteners, and one end of a strap is affixed thereto. The other end of the strap is formed into a noose which loops around the barrel of the gun, and the strap is adjusted to the desired length. The problem with a noose is that it can only be used on objects that it can loop around, and it is therefore somewhat limited in its utility.

In both the Hirschkoff and Hughes devices, the use of Velcro® limits their utility. Thus, if a user attempts to carry anything heavier than skis, he runs the risk of having the fasteners part. In the Hughes arrangement, it would appear that the fastener is not under as great a stress as in the Hirschkoff device, but under heavy loads the risk of parting of the fastener still exists and increases with load.

Both the Hirschkoff and Hughes devices are specialized in function, each being intended for a specific use. Both arrangements, therefore, lack the degree of universality of use that can be achieved with a simple rope, their only advantages over a rope being length adjustment and no necessity of tying knots.

SUMMARY OF THE INVENTION

The present invention is a universal strap having a wide variety of applications which can be folded into a small bundle for carrying when not in use, or which can be worn as a belt when not being utilized for other purposes. The strap of the invention can be adjusted as to length, can be looped at one or both ends with loops of a desired size, and comes equipped with the necessary hardware to adapt it to a multiplicity of configurations and uses.

In an illustrative embodiment of the invention the strap comprises a first elongated member of, for example, woven nylon webbing, approximately one inch in width. A first end of the elongated member is passed through a single bar slide of a polypropylene or Delrin® material which first has first and second outer bars and a single centrally located bar. The first end of the strap is passed under the first outer bar, over the center bar and under the second outer bar, and folded back upon itself and affixed to the strap. The other or second end of the elongated member is also passed under the first outer bar, through a D-ring, over the center bar, and under the second outer bar, overlying that portion of the member previously passed through the slide with the first end of the member. The loop thus formed has slidably mounted thereon a clip member of polypropylene or Delrin® which is movable about a plurality of axes. In a like manner, the first and second ends of a second elongated member is passed through a single bar slide to form a second loop which carries a slidably mounted clip, with a D-ring located at the slide.

The second end of the first member passes through a second single bar slide, slidably through a flexible pad member and through a third single bar slide. The second end of the second elongated member is passed through the third single bar slide, overlying the first elongated member, through the flexible pad member where it overlies the first elongated member, and through the second single bar slide, overlying the first elongated member. For increased versatility, D-rings may be slidably located at the second and third single bar slide members.

The universal strap of the invention, as described in the foregoing, can be folded into a compact bundle which can easily be carried in a pocket. Alternatively, the strap may be worn around the waist and tools or other items may be clipped to the D-rings. The four single bar slide members permit adjustment of the overall length of the strap and of the size of the loops at either end, while the clips and D-rings make it possible to form holding loops of virtually any desired size.

The various features and advantages of the present invention, as well as the uses to which it may be put, will be more readily apparent from the following detailed description, read in conjunction with the accompanying drawings.

DETAILED DESCRIPTION

Figure 1:
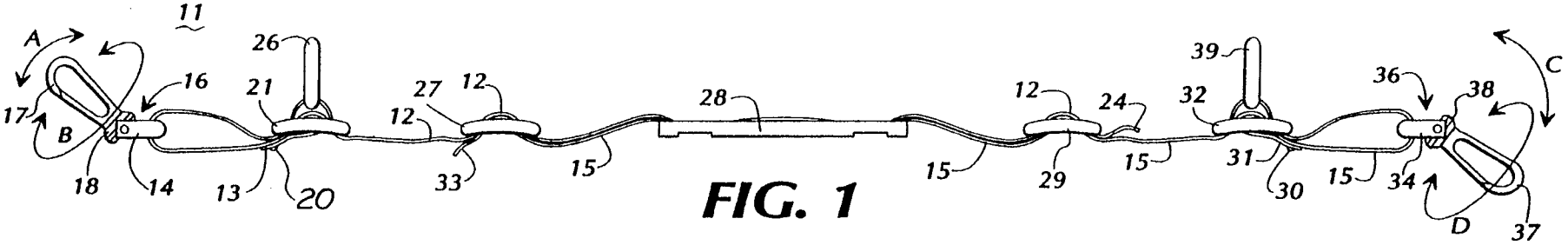
FIG. 1 is an elevation view of the universal strap of the present invention.

In FIG. 1, there is shown a strap 11 embodying the principles of the present invention, and which comprises a first and a second elongated flexible strap member 12 and 15 of, for example, woven nylon webbing or other suitable flexible, lightweight material having a high tensile strength. A first end 13 of strap 12 passes through the retaining ring 14 of a clip member 16. Clip member 16 preferably comprises retaining ring 14 and a clip 17 having a base portion 18 which is pivotally mounted to ring 14 to permit movement of clip 17 as shown by arrow A. Clip 17 is swivelly mounted to base 18 to permit movement of clip 17 as shown by arrow B. Clip member 16 is preferable made of polypropylene or Delrin® and may have a load rating of six hundred pounds or more, for example.

Figure 1C:
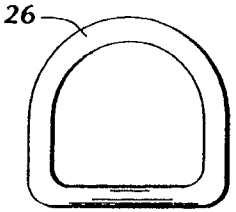
FIG. 1C is a plan view of a detail of the strap of FIG. 1.
Figure 1B:
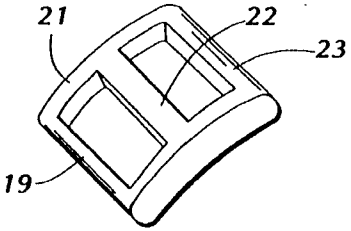
FIG. 1B is a plan view of a detail of the strap of FIG. 1.
Figure 1A:
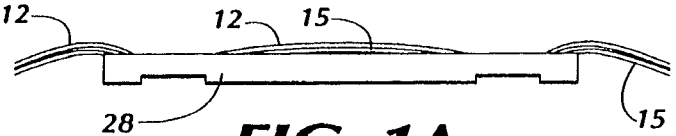
FIG. 1A is an elevation view of a detail of the strap of FIG. 1.

End 13 passes under a first outer bar 19 of a single central bar slide 21, shown in FIG. 1B, which is also preferably made of polypropylene or Delrin®, passes over central bar 22 and under the second outer bar 23 and is then doubled back and affixed to strap 12, as shown, by rivet 20, or by stitching or other suitable means. The other end 24 of elongated strap 12 passes under bar 19 and overlays the end portion 13, through a D-ring 26, shown in FIG. 1C, and under bar 23 of slide 21, overlying the end portion 13 as shown. End 24, and hence strap member 12 passes under the first outer bar of a second single center bar slide 27, which is substantially identical to slide 21, over the center bar and under the second outer bars, and overlays strap member 15, as shown. End 24 and strap 12 then pass through a pad or grip member 28 which may take any of a number of forms, that being shown in FIG. 1A being one example. Pad member 28, as shown in FIG. 1A is similar in configuration to slides 21 and 27, but has an elongated center portion instead of a center bar. It is preferably made of rubber or other pliable material for gripping by hand or for use as a support pad, as will be discussed hereinafter. As shown in FIG. 1A, strap member 12 overlays member 15 as it passes through member 28. End 24 and strap member 12 then pass through a third single center bar slide 29, which is substantially identical to slides 21 and 27. Strap 12 overlays strap 15, as shown, and continues for a short distance beyond slide 29.

In a like manner, a first end 31 of strap member 15 passes under the outer bar of a fourth single center bar slide 32 which is substantially identical to slides 21, 27, and 29, and is doubled back and affixed to strap member 15, by rivet 30 as shown or by stitching or cement. The other end 33 of strap member 15 passes through the retaining ring 34 of a clip assembly 36. Clip assembly 36 is, for purposes of illustration, substantially identical to clip assembly 16, and comprises, in addition to retaining ring 34, a clip 37 swivelly mounted to a base member 38 which is, in turn, pivotally mounted to retaining ring 34, thus allowing movement of clip 37 as indicated by the arrows C and D. End 33 and strap 15 pass under the first outer bar of slide 32, through a D-ring 39 over the center bar, and under the other outer bar of clip 32, overlaying the end portion 31, as shown. End 33 and strap member 15 then pass through slide 29, underlying strap member 12, through member 29, underlying strap member 12, and through slide 27, again underlying strap member 12.

Figure 2:
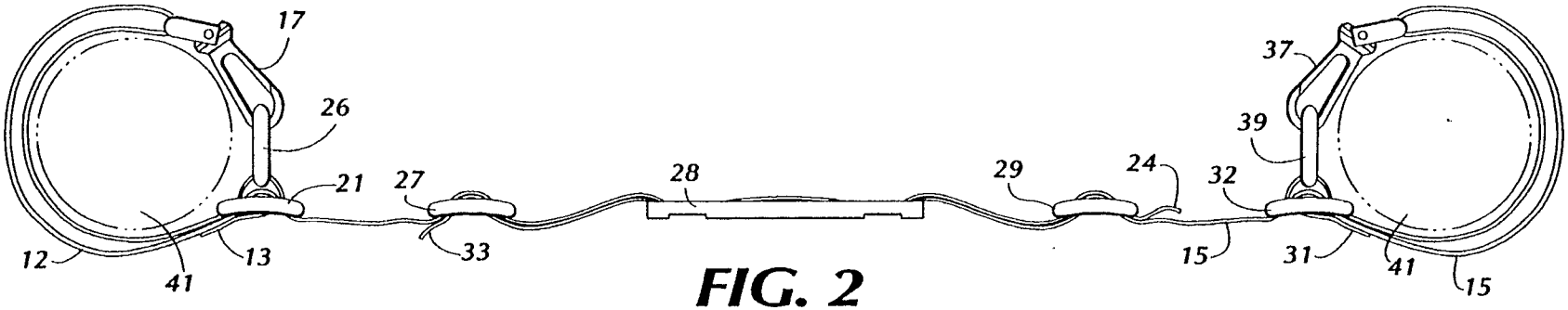
FIG. 2 is an elevation view of the strap of FIG. 1 in one useful configuration.

The strap assembly 11 as shown in FIG. 1 and as described in the foregoing, can be, through the judicious use of slides 21, 27, 29 and 32, lengthened or shortened through a wide range without affecting or lessening the tensile strength and hence the load carrying capabilities of the strap 11, and the clip assemblies 16 and 36, with their associated D-rings 26 and 39, respectively, can be formed into load carrying loops or slings 41, as shown in FIG. 2. The arrangement shown in FIG. 2 is a general configuration for carrying a pair of circular loads, as shown in dashed lines, but it is not limited to such a load configuration. Also, the loads are shown being carried in loops 41 which do not grasp the load. It can be appreciated that the loops 41 can be tightened around the load or loads when it is necessary to inhibit slipping thereof. The strap assembly 11 does not rely on flue, stitching or riveting to bear the load, hence, the strength of the strap 11 is dependent only on the great tensile strength of the webbing.

FIGS. 3A through 3G illustrate the versatility and utility of the strap of FIGS. 1 and 2. Although these figures demonstrate a wide range of uses for the strap, it is to be understood that numerous other configurations and uses thereof are possible, being limited only by the imagination or ingenuity of the user.

Figure 3C:
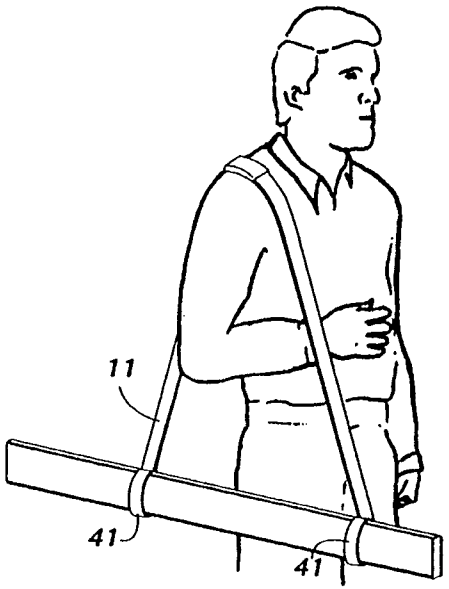
FIG. 3C illustrates a fourth configuration and use of the strap.
Figure 3D:
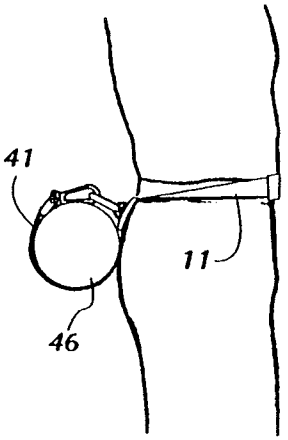
FIG. 3D illustrates a fifth configuration and use of the strap.
Figure 3B:
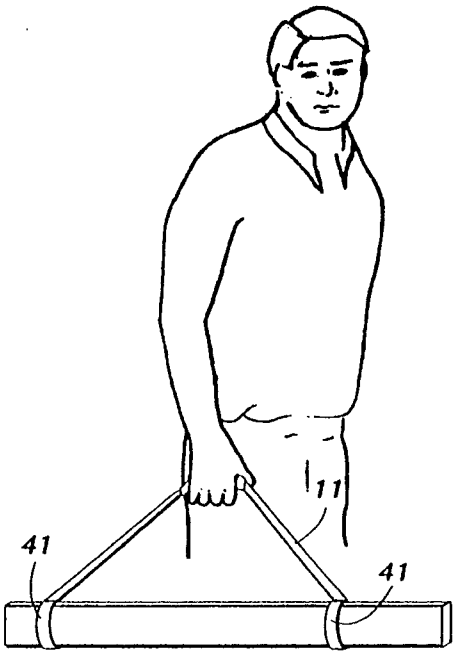
FIG. 3B illustrates a third configuration of the strap of the invention.
Figure 3A:
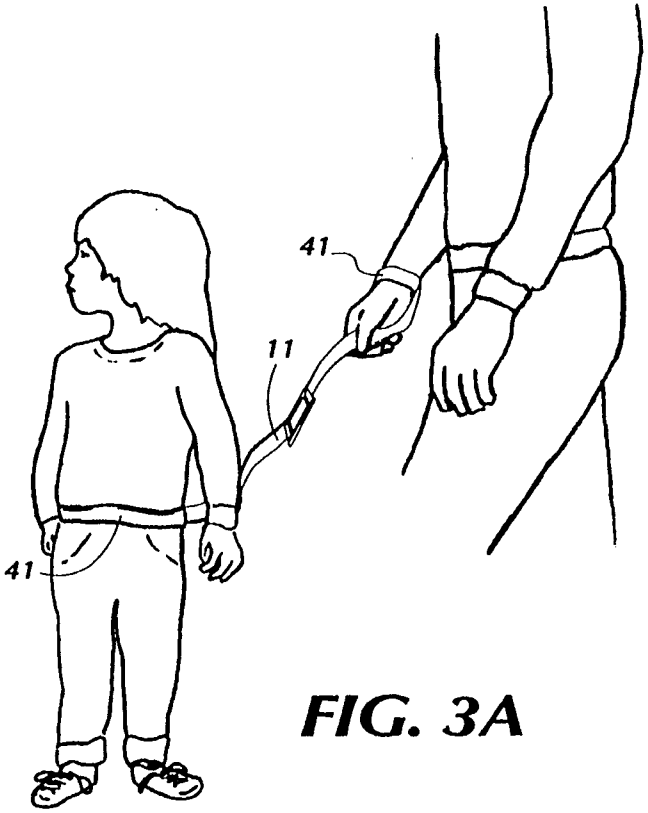
FIG. 3A illustrates a second configuration of the strap of the invention.

In FIG. 3A, the strap is shown as a form of leash or tether for a small child. One end loop of the strap is looped about the child's waist as a belt and tightened sufficiently to prevent the child from slipping out, and the other end is looped about the parent's waist as a belt. If the child is wearing a halter, it may not be necessary to loop the end around the child if it can be clipped to the halter.

In FIG. 3B the strap is shown configured for carrying a relatively long, heavy object such as, for example, a two-by-four stud member. It can be seen that the loops 41, 41 are spaced apart and are tightened about the work piece and the strap is gripped by the user at pad 28. FIG. 3C shows substantially the same configuration, but the strap is carried over the shoulder.

The arrangement of FIG. 3D might be used by hikers or the like who wish to carry a blanket roll, a rolled up slicker, etc. The strap 11 is fitted about the user's waist as a belt and the loops 41, 41 hold the roll 46 not only in rolled up condition, but in place against the small of the back of the user. Larger rolls or heavier objects may be carried as shown in FIG. 3L, where the pad 28 rests against the user's forehead and the workpiece 47 rests against the back. In both FIG. 3D and 3E, where the work piece is held in rolled up form by its own straps, for example, the clips 17 and 37 may be used instead of the loops 41, 41, if desired.

Figure 3G:
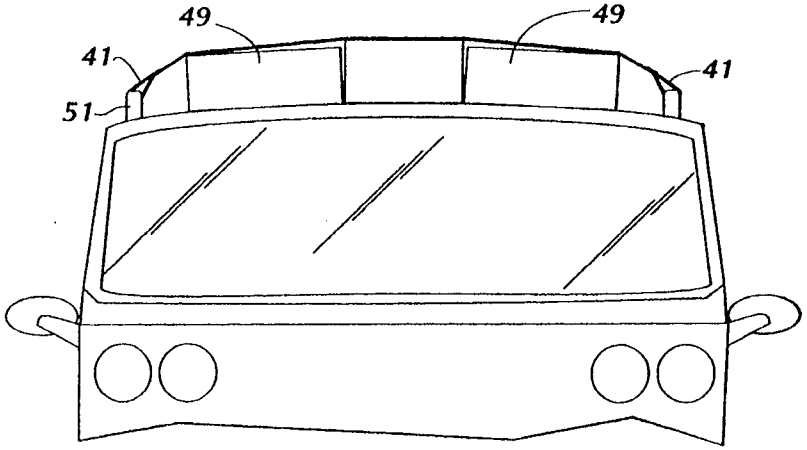
FIG. 3G illustrates another configuration and use of the strap.
Figure 3H:
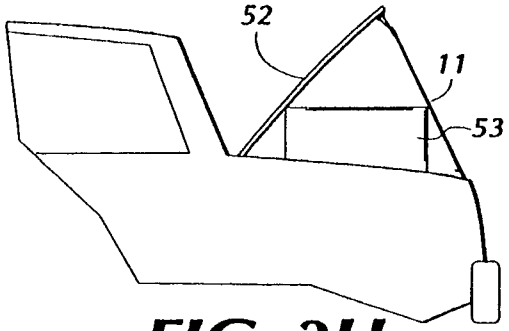
FIG. 3H illustrates still another configuration and use of the strap.
Figure 3F:
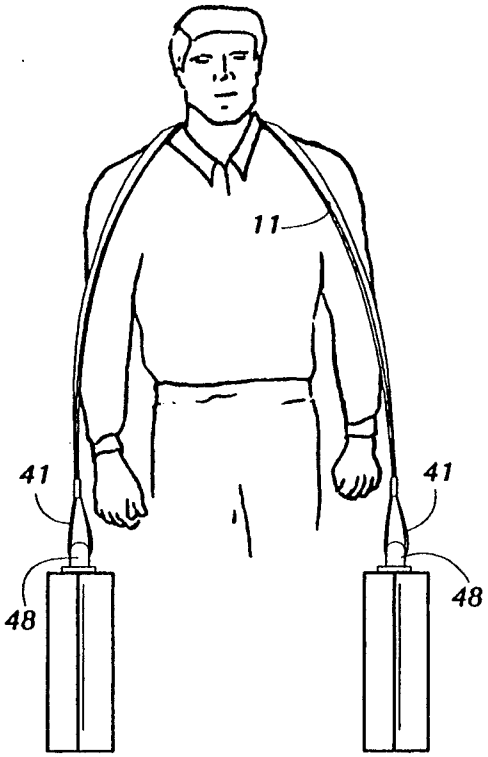
FIG. 3F illustrates a seventh configuration and use of the strap.
Figure 3E:
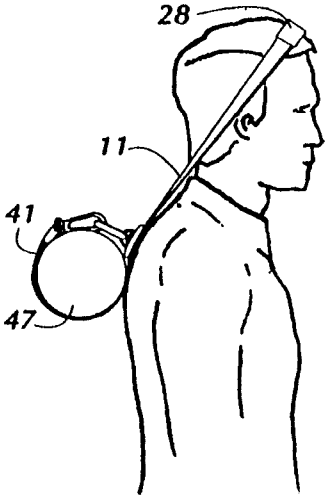
FIG. 3E illustrates a sixth configuration and use of the strap.

FIG. 3F shows the strap configuration useful for carrying luggage, for example. The loops 41, 41 are looped through the luggage handles 48, 48 and the strap is worn over the shoulders of the user. Such an arrangement makes it possible for anyone to carry even very heavy pieces of luggage.

FIGS. 3G and 3H illustrate configurations of the strap for use with automobiles. The strap 11 may be used as a tie-down for work pieces 49, 49 to be carried in the luggage rack 51 of an automobile. The loops 41 are secured to the longitudinal rails of the rack 51, and the strap is tightened down over the work pieces 49, 49. Motorists are often frustrated with having to carry objects that are too large to fit within their car, which does not have a luggage rack. As a consequence, such an object must be carried in the trunk of the car, but the trunk lid cannot be closed and latched. As shown in FIG. 3H, the strap 3H of the invention can be easily adapted to hold the truck lid 52 down against the load 53 so that it will not bounce with consequent potential damage to the hinges or to the load. The foregoing illustrations of the versatility of the strap of the invention are just a few of any number of possible configurations and uses thereof. There are numerous other possible uses, such as an emergency tourniquet, which can be loosened or tightened with ease. Two or more straps might be used in conjunction with each other for very heavy loads, for example. The dimensions and materials given in the foregoing are by way of example, and, while preferred, are not meant to be restrictive.

It is to be understood that the foregoing is descriptive of an illustrative, preferred embodiment of the invention. Numerous variations or changes may occur to workers skilled in the art without departure from the spirit and scope of the invention.

I claim:

1. A universal strap comprising:

a first elongated strap member having first and second ends;

a second elongated strap member having first and second ends;

a first slide member;

said first end of said first strap member being passed through said first slide member and being bent back and affixed to said first strap member;

said second end of said first strap member being passed through said first slide member and overlaying the portion of the first strap member adjacent said first end to form a loop in said first strap member;

first clip means slidably supported on the loop thus formed;

a first ring member;

said second end of said first strap member passing through said first ring member to retain said first ring member adjacent said first slide member, a second slide member through which the said second end of said first strap member passes;

an elongated pad member through which said second end of said first strap member passes;

a third slide member through which the said second end of said first strap member passes;

a fourth slide member;

said first end of said second strap member being passed through said fourth slide member and being bent back and affixed to said second strap member;

said second end of said second strap member being passed through said fourth slide member and overlaying the portion of the second strap member adjacent said first end to form a loop in said second strap member;

second clip means slidably supported on the loop thus formed;

a second ring member;

said second end of said second strap member being passed through said second ring member to retain said second ring member adjacent said fourth slide member, and said second end of said second strap member being passed through said third slide member, said elongated pad member, and said second slide member in underlying relation to said first strap member.

2. A universal strap as claimed in claim 1 wherein said first and second strap members are made of woven webbing.

3. A universal strap as claimed in claim 1 wherein said slide member and said ring members are made of polypropylene.

4. A universal strap as claimed in claim 1 wherein said first end of said first strap member and said first end of said second strap member are affixed to said strap first and second strap members respectively by riveting.

5. A universal strap as claimed in claim 1 wherein said first ring member is pivotable with respect to said first slide member.

6. A universal strap as claimed in claim 5 wherein said second ring member is pivotable with respect to said fourth slide member.

* * * * *